US005139097A

United States Patent [19]

Rajala

[11] Patent Number: 5,139,097

[45] Date of Patent: Aug. 18, 1992

[54] ROCK DRILLING APPARATUS

[75] Inventor: Rauno Rajala, Ylöjärvi, Finland

[73] Assignee: Oy Tampella Ab, Tampere, Finland

[21] Appl. No.: 498,759

[22] Filed: Mar. 26, 1990

[30] Foreign Application Priority Data

Apr. 5, 1989 [FI] Finland ..... 891631

[51] Int. Cl.[5] ..... E21B 3/02

[52] U.S. Cl. ..... 175/122; 173/4; 173/141; 175/162; 175/203

[58] Field of Search ..... 175/122, 162, 203, 220; 173/22, 28, 141, 4

[56] References Cited

U.S. PATENT DOCUMENTS

| | | | |
|---|---|---|---|
| 2,842,340 | 7/1958 | Burress | 255/51 |
| 3,091,439 | 5/1963 | Adams et al. | 262/26 |
| 3,409,089 | 11/1968 | Meyer | 173/9 |
| 3,670,826 | 6/1972 | Hanson et al. | 173/4 |
| 3,933,208 | 1/1976 | Bailey et al. | 173/141 X |
| 4,341,271 | 7/1982 | Anttila | 175/24 |
| 4,498,544 | 2/1985 | Molin | 173/1 |
| 4,503,918 | 3/1985 | Bergkvist et al. | 175/27 |
| 4,639,868 | 1/1987 | Tanaka et al. | 175/24 X |

FOREIGN PATENT DOCUMENTS

| | | | |
|---|---|---|---|
| 1229943 | 12/1966 | Fed. Rep. of Germany . | |
| 2407997 | 8/1975 | Fed. Rep. of Germany . | |
| 1218101 | 3/1986 | U.S.S.R. | 175/220 |
| 1295749 | 11/1972 | United Kingdom . | |
| 2196666 | 5/1988 | United Kingdom | 173/22 |

*Primary Examiner*—Hoang C. Dang
*Attorney, Agent, or Firm*—Nixon & Vanderhye

[57] ABSTRACT

The invention relates to a rock drilling apparatus comprising a carrier and at least one drill boom mounted in the carrier and provided with a drifter and a feeding beam. Valves for the control of the operations of the drifter and the feeding beam are arranged in the form of an integral control unit. The control unit is mounted in a cradle provided for the feeding beam and it communicates with the carrier by means of merely two pressure fluid hoses and a control cable.

8 Claims, 2 Drawing Sheets

ROCK DRILLING APPARATUS

Figure 1:
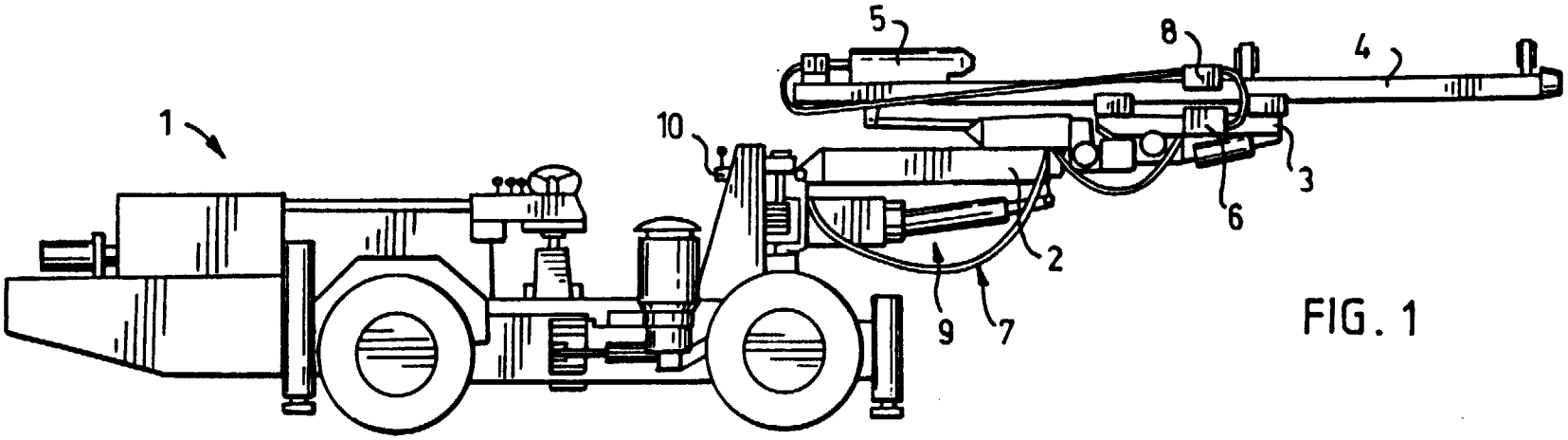

The invention relates to a rock drilling apparatus comprising a carrier and a drill boom attached at its one end to the carrier and having drilling means attached to its other end, the drilling means comprising at least a feeding beam, a drifter movable longitudinally of the feeding beam, actuators for operating the drilling means, pressure fluid hoses for applying pressure fluid from the carrier to and away from the drifter and the actuators of the drilling means, and control valves for controlling the operation of the drilling means.

A rock drilling apparatus comprises a carrier which is movable on wheels or the like and to which at least one drill boom is attached. A feeding beam along which a drifter moves during drilling is attached to each drill boom. To control the drilling process, a control unit supplied with pressure fluid from a hydraulic pump and comprising valves for controlling the operations of both the drifter and the feeding device is mounted in the carrier. The valves communicate with the feeding device and the drifter by means of several hydraulic hoses supplying pressure fluid to the different actuators for displacing the feeding beam and the drifter to a drilling position and for drilling a hole and correspondingly for returning them to the initial position after the hole has been drilled.

It is often problematic to position the control unit with a plurality of hydraulic valves, connection components and hoses on the carrier of the drilling apparatus. A great number of hoses of different types has to be provided between the power unit containing the hydraulic pump and the control unit and the drifter, and the hoses hang loosely as they have to be passed over various turning and displacing structures. The great number of hoses is difficult to pass from the control unit to the drill boom as they have to be protected against damage and as they are also considerably heavy, which has to be taken into account in the design of the apparatus. Furthermore, it is difficult to pass the hoses along the boom and over the joints of the boom system to the feeding beam and the drifter in the narrow spaces due to the requisite movements of the feeding beam; the hoses also take plenty of space.

The object of the present invention is to avoid the above-mentioned problems and to provide a rock drilling apparatus in which it is not necessary to pass large bundles of hoses along the apparatus from one unit to another and which provides a small control unit easy to install and simple to realize. This is achieved according to the invention in such a manner that the control valves are electrically controllable and arranged in the form of a fixed control unit fitted in the drilling means, pressure fluid being supplied from the carrier to the drifter and the actuators of the drilling means by means of the pressure fluid hoses connected between the carrier and the control unit, and pressure fluid hoses required for operating the drifter and each actuator being connected from the control unit to the drifter and each actuator, and a control cable being connected between the carrier and the control unit to control the valves.

The basic idea of the invention is that the drifter and the feeding device are controlled by means of valves controlled electrically or in some other remote-controlled manner and forming a separate fixed control unit which is positioned in connection with the feeding beam after the joints interconnecting the feeding beam and the boom. When using this solution, a single pair of hoses is enough for the control of the drifter and the feeding beam, pressure fluid being supplied to the valves through one hose and return fluid returned to the carrier through the other hose. In addition, a control cable is needed, which may comprise merely electric wires or both electric wires and optic cable. In this way large bundles of hoses are avoided as well as the problems associated with their installation from the carrier to the feeding beam and the drifter, because the connections between the valves needed for the control of the feeding beam can be arranged to form a fixed valve assembly in the form of a control unit. The control unit communicates with each actuator by means of pressure fluid conduits and hoses which can be positioned so as to enable easiest possible installation in such a way that they are not liable to damage during operation. Moreover, the number of hydraulic connections in the carrier is reduced, because the space requirement of components used in a control system effected electrically or in some other similar manner is as such very small. In practice, the required installation space is determined by the spaces required between the mechanical control means and the centralizer. Furthermore, the control unit can be constructed by using a prior art cartridge valve structure easy to realize. In this way the control unit including the valves becomes very small and easy to install in connection with the feeding beam.

Figure 2:
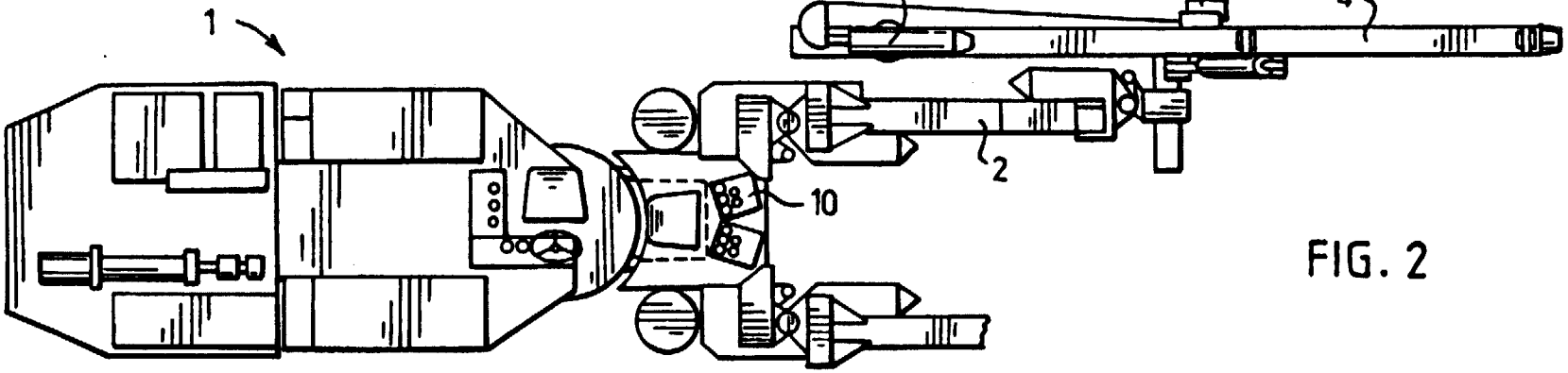
Figure 3:
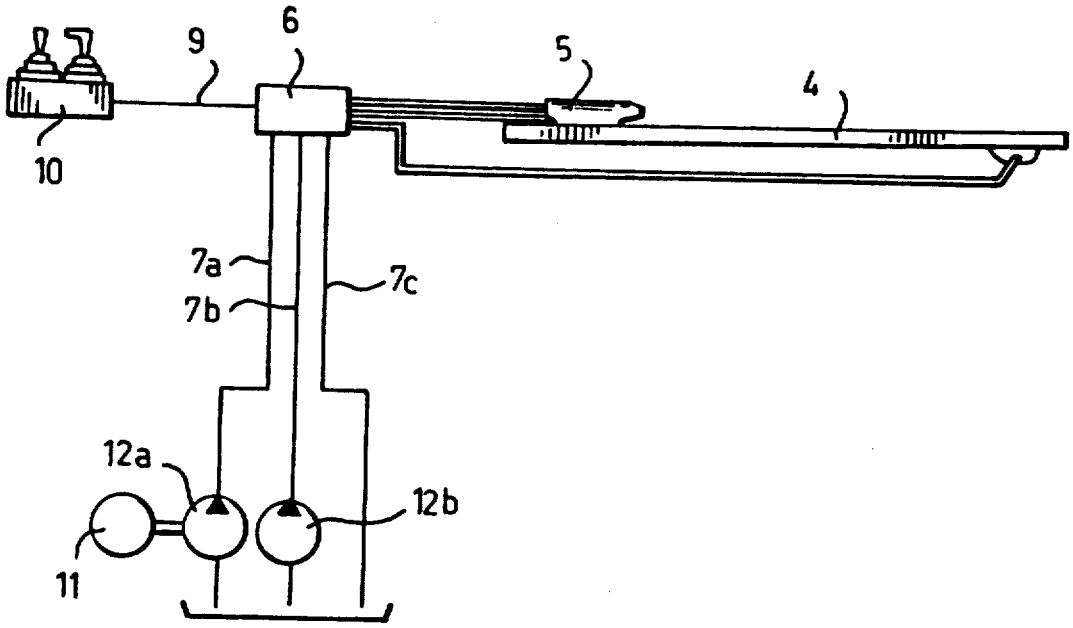

The invention will be described in greater detail in the attached drawings, in which FIG. 1 is a side view of one embodiment of a rock drilling apparatus of the invention;

FIG. 2 is a top view of one embodiment of the rock drilling apparatus of the invention; and FIG. 3 is a schematic view of one embodiment of a pressure fluid connection used in the rock drilling apparatus of FIGS. 1 and 2.

FIGS. 1 and 2 show a rock drilling apparatus comprising a carrier 1 movable on wheels. Various components and devices known per se in rock drilling apparatuses are mounted on the carrier. These components and devices will not be described in more detail herein. A drill boom 2 is attached to the front end of the carrier 1, and a cradle 3 is mounted at the end of the drill boom. A feeding beam 4, in turn, is mounted in the cradle 3 longitudinally movably relative to it. Drilling means comprising a drifter 5 is mounted longitudinally movably on the feeding beam. The boom 2 turns relative to the carrier 1 about various joints in a manner known per se. Correspondingly, the cradle 3 turns relative to the end of the boom 2 about various joints in a manner known per se. These joints will not be described more closely. Valves required for displacing the feeding beam in its longitudinal direction relative to the cradle and correspondingly for controlling the operation of the drifter 5 are mounted in a separate control unit 6 at the side of the cradle 3. The control unit 6 communicates with the carrier 1 by means of two or in some cases three pressure fluid hoses 7. From the control unit 6 pressure fluid hoses for each actuator and the drifter 5 are passed to a fitting stand 8 and further from it in a manner known per se to each actuator and the drifter 5. The fitting stand 8, the purpose of which is mainly to fix the hoses at one point, is attached to the feeding beam 4, and flexible hoses allowing the movement of the feeding beam 4 relative to the cradle 3 in its longitudinal direction are mounted between the control unit 6 and the fitting stand 8. Furthermore, a control cable 9 goes from a control panel 10 in the carrier 1 to the control unit 6 of each drill boom.

FIG. 3 is a similar schematic view of a connection realized according to the invention, in which the same reference numerals as in FIGS. 1 and 2 are used for corresponding parts. The control panel 10 is connected to the control unit 6 by means of the control cable 9. Pumps 12*a* and 12*b* rotated by a motor 11 communicate with the control unit 6 by means of pressure fluid hoses 7*a* and 7*b* and a return hose 7*c*. From the control unit the pressure fluid is further passed to the drifter 5 and to the actuators of the feeding beam 4 in response to control impulses or signals supplied from the control panel 10.

In the most advantageous case, the operation of the feeding beam 4 and the drifter 5 in the solutions of FIGS. 1 and 2 can be controlled by two pressure fluid hoses and a control cable connected between the carrier 1 and the feeding beam 4 or the cradle 3 of each drill boom, which simplifies their installation and the design of the boom and requires considerably less space and safety measures as compared with the structure known from the prior art. Furthermore, since the control of the feeding beam and the drifter requires active operation only intermittently, for example, on initiating or ending drilling and when the equipment is moved for drilling a new hole, it is possible to use a very simple solution in which electric control is applied in such a manner that all the drill booms have a common control panel 10 and the control table is provided with a change-over switch for selecting the boom the feeding beam and/or the drifter of which is to be controlled. In FIGS. 1 and 2, the control unit 6 is mounted in the cradle of the feeding beam; however, it can also be mounted in the feeding beam or even in the drifter. The principle of the invention can also be applied to structures in which the feeding beam is not longitudinally movable relative to the boom and to all feeding beamdrifter arrangements known per se to be used at the end of various booms. The invention is not in any way restricted to solutions realized by one specific control connection and valve structure, but the control unit can be formed by valves of different types so as to meet the requirements of the feeding beam and the drifter and the way of control used in each particular case, the valves being assembled into a fixed integral unit in which the pressure fluid conduits between the valves are preferably realized as fixed conduits provided between the different parts of the unit without any extra hoses between the different valves.

I claim:

1. A rock drilling apparatus comprising a carrier and a drill boom attached at its one end to the carrier and having drilling means attached to its other end, the drilling means comprising at least a feeding beam, a drifter movable longitudinally of the feeding beam, actuators for operating the drilling means, pressure fluid hoses for applying pressure fluid from the carrier to and away from the drifter and the actuators of the drilling means, and control valves for controlling the operation of the drilling means, wherein said control valves are electrically controllable and arranged in the form of a fixed control unit fitted in the drilling means, pressure fluid being supplied from the carrier to the drifter and the actuators of the drilling means by means of the pressure fluid hoses connected between the carrier and the control unit, and pressure fluid hoses required for operating the drifter and each actuator being connected from the control unit to the drifter and each actuator, and a control cable being connected between the carrier and the control unit to control the valves.

2. A rock drilling apparatus according to claim 1, wherein said control valves are cartridge valves fitted in a frame in which conduits interconnecting the valves are provided.

3. A rock drilling apparatus comprising a carrier and a drill boom attached at its one end to the carrier and having drilling means attached to its other end, the drilling means comprising at least a feeding beam, a drifter movable longitudinally of the feeding beam, actuators for operating the drilling means, pressure fluid hoses for applying pressure fluid from the carrier to and away from the drifter and the actuators of the drilling means, and control valves for controlling the operation of the drilling means, wherein said control valves are electrically controllable and arranged in the form of a fixed control unit fitted in the drilling means and mounted within the feeding beam, pressure fluid being supplied from the carrier to the drifter and the actuators of the drilling means by means of the pressure fluid hoses connected between the carrier and the control unit, and pressure fluid hoses required for operating the drifter and each actuator being connected from the control unit to the drifter and each actuator, and a control cable being connected between the carrier and the control unit to control the valves.

4. A rock drilling apparatus comprising a carrier and a drill boom attached at its one end to the carrier and having drilling means attached to its other end, the drilling means comprising at least a feeding beam, a drifter movable longitudinally of the feeding beam, actuators for operating the drilling means, pressure fluid hoses for applying pressure fluid from the carrier to and away from the drifter and the actuators of the drilling means, and control valves for controlling the operation of the drilling means, wherein said control valves are electrically controllable and arranged in the form of a fixed control unit fitted in the drilling means and mounted in a cradle provided for the longitudinally displaceable feeding beam, pressure fluid being supplied from the carrier to the drifter and the actuators of the drilling means by means of the pressure fluid hoses connected between the carrier and the control unit, and pressure fluid hoses required for operating the drifter and each actuator being connected from the control unit to the drifter and each actuator, and a control cable being connected between the carrier and the control unit to control the valves.

5. A rock drilling apparatus comprising a carrier, a drill boom extending from said carrier, a drill attached to said drill boom at a position remote from said carrier;

said drill having a feeding beam, a drifter moving said drill longitudinally of said feeding beam, actuators for operating said drill, pressure fluid hoses carrying pressure fluid from said carrier to and from said drifter and said actuators, and control valves operatively coupled to said hoses for controlling said drill, said control valves being housed in a control unit fixed to said drill, said pressure fluid hoses coupled to said control unit, and a control cable connected to said control unit and to said carrier.

6. A rock drilling apparatus as in claim 5, wherein said control cable is operatively coupled to a control panel and said control valves operate in response to electrical control signals from said control panel and conveyed by said control cable.

7. A rock drilling apparatus as in claim 5, wherein said control unit is coupled to a pump via a plurality of pump pressure fluid hoses that carry pressure fluid to and from said control unit.

8. A rock drilling apparatus as in claim 6, wherein said control unit is coupled to a pump via a plurality of pump pressure fluid hoses that carry pressure fluid to and from said control unit.

* * * * *